US008695761B1

(12) United States Patent
Berkbuegler

(10) Patent No.: US 8,695,761 B1
(45) Date of Patent: Apr. 15, 2014

(54) CABLE-BRACED LADDER TREE STAND

(76) Inventor: Ronald Berkbuegler, Troy, IL (US)

( * ) Notice: Subject to any disclaimer, the term of this patent is extended or adjusted under 35 U.S.C. 154(b) by 1732 days.

(21) Appl. No.: 11/891,118

(22) Filed: Aug. 9, 2007

Related U.S. Application Data

(60) Provisional application No. 60/872,105, filed on Dec. 1, 2006.

(51) Int. Cl.
*E06C 7/16* (2006.01)

(52) U.S. Cl.
USPC ..... 182/116; 182/115; 182/218

(58) Field of Classification Search
USPC ..... 182/116, 115, 218
See application file for complete search history.

(56) References Cited

U.S. PATENT DOCUMENTS

| | | | | | |
|---|---|---|---|---|---|
| 175,095 | A | | 3/1876 | Hoehn | |
| 179,262 | A | | 6/1876 | Buestrin | |
| 189,690 | A | | 4/1877 | Boynton | |
| 194,588 | A | | 8/1877 | Duncan | |
| 197,324 | A | | 11/1877 | Boynton | |
| 204,962 | A | * | 6/1878 | Fox | 182/218 |
| 228,647 | A | | 6/1880 | King | |
| 235,255 | A | | 12/1880 | King | |
| 240,757 | A | | 4/1881 | Owen | |
| 267,803 | A | | 11/1882 | Seagrave | |
| 278,051 | A | | 5/1883 | Seagrave | |
| 409,722 | A | * | 8/1889 | Winkless | 182/39 |
| 493,977 | A | | 3/1893 | Childs | |
| 586,341 | A | | 7/1897 | Maguire | |
| 665,780 | A | | 1/1901 | Hayward | |
| 735,371 | A | | 8/1903 | Hayward | |
| 745,343 | A | | 12/1903 | Garrison et al. | |
| 976,074 | A | | 11/1910 | Hartman | |
| 993,867 | A | | 5/1911 | Palmer | |
| 1,067,170 | A | | 7/1913 | Hewett | |
| 1,776,565 | A | | 9/1930 | Morton | |
| 1,953,390 | A | * | 4/1934 | Bosch | 182/16 |
| 2,348,136 | A | | 5/1944 | Kidd et al. | |
| 2,406,786 | A | * | 9/1946 | Aukland | 182/131 |
| 2,415,461 | A | | 2/1947 | Causey | |
| 2,837,260 | A | * | 6/1958 | Kinnett | 182/106 |
| 3,009,534 | A | * | 11/1961 | Folley | 182/119 |
| 3,336,999 | A | * | 8/1967 | McSwain | 182/20 |
| 3,406,784 | A | * | 10/1968 | Jones et al. | 182/97 |
| 3,698,512 | A | | 10/1972 | Cebular | |
| 4,401,184 | A | * | 8/1983 | Sherry | 182/45 |
| 4,545,460 | A | | 10/1985 | Byrd | |
| 4,565,262 | A | | 1/1986 | Hawkins | |
| 4,579,198 | A | | 4/1986 | Lee | |
| 4,699,248 | A | * | 10/1987 | Roy | 182/116 |

(Continued)

*Primary Examiner* — Katherine Mitchell
*Assistant Examiner* — Candace L Bradford
(74) *Attorney, Agent, or Firm* — Senniger Powers LLP

(57) ABSTRACT

A ladder tree stand for supporting a hunter at an elevated position, comprising a seating platform assembly, a ladder assembly, and a truss assembly. The seating platform is adapted for frictional engagement with a tree. The ladder assembly has an upper end and a lower end, wherein the upper end of the ladder assembly is supportingly connected to the platform. The truss assembly includes a flexible cable and a brace. The flexible cable has a first end connected to the ladder assembly near the upper end of the ladder assembly and a second end connected to the ladder assembly near the lower end of the ladder assembly The brace is connected to the ladder assembly and in engagement with the flexible cable to space an intermediate portion of the flexible cable from the ladder assembly for tensioning the flexible cable to thereby brace the ladder assembly against deflection.

15 Claims, 2 Drawing Sheets

(56) References Cited

U.S. PATENT DOCUMENTS

| | | | | | |
|---|---|---|---|---|---|
| 4,761,847 | A * | 8/1988 | Savage et al. | 14/69.5 |
| 4,792,016 | A | 12/1988 | Ingalsbe et al. | |
| 5,067,588 | A | 11/1991 | Bendickson | |
| 5,105,908 | A * | 4/1992 | Freund | 182/20 |
| 5,253,732 | A * | 10/1993 | Daniels | 182/116 |
| 5,277,273 | A * | 1/1994 | Grimes | 182/187 |
| 5,279,390 | A | 1/1994 | Phillips | |
| 5,704,448 | A * | 1/1998 | Jenkins, Jr. | 182/93 |
| 5,740,882 | A * | 4/1998 | Griffith et al. | 182/20 |
| 5,890,560 | A | 4/1999 | Sloop | |
| 6,003,632 | A * | 12/1999 | Miller | 182/116 |
| 6,053,278 | A | 4/2000 | Myers | |
| 6,199,660 | B1 * | 3/2001 | Meeks | 182/116 |
| 6,334,508 | B1 * | 1/2002 | Shields | 182/116 |
| 6,505,707 | B1 * | 1/2003 | Berry | 182/20 |
| 6,516,918 | B2 | 2/2003 | Hess | |
| 6,684,812 | B1 * | 2/2004 | Tucker | 119/57.91 |
| 6,719,093 | B2 * | 4/2004 | Garbs | 182/116 |
| 7,021,423 | B1 * | 4/2006 | Pestrue et al. | 182/116 |
| 7,370,725 | B1 * | 5/2008 | Dornfeld | 182/2.2 |
| 7,717,232 | B2 * | 5/2010 | Butcher | 182/178.3 |
| 2003/0146048 | A1 * | 8/2003 | Garbs | 182/116 |
| 2003/0230454 | A1 * | 12/2003 | Morgan | 182/178.1 |
| 2005/0178615 | A1 | 8/2005 | Woller et al. | |
| 2005/0224288 | A1 * | 10/2005 | Chesness et al. | 182/115 |
| 2007/0199769 | A1 * | 8/2007 | Chesness et al. | 182/115 |
| 2007/0256892 | A1 * | 11/2007 | Breedlove, Sr. | 182/116 |
| 2008/0105490 | A1 * | 5/2008 | Butcher | 182/116 |
| 2009/0277721 | A1 * | 11/2009 | Weir | 182/115 |

* cited by examiner

FIG - 2
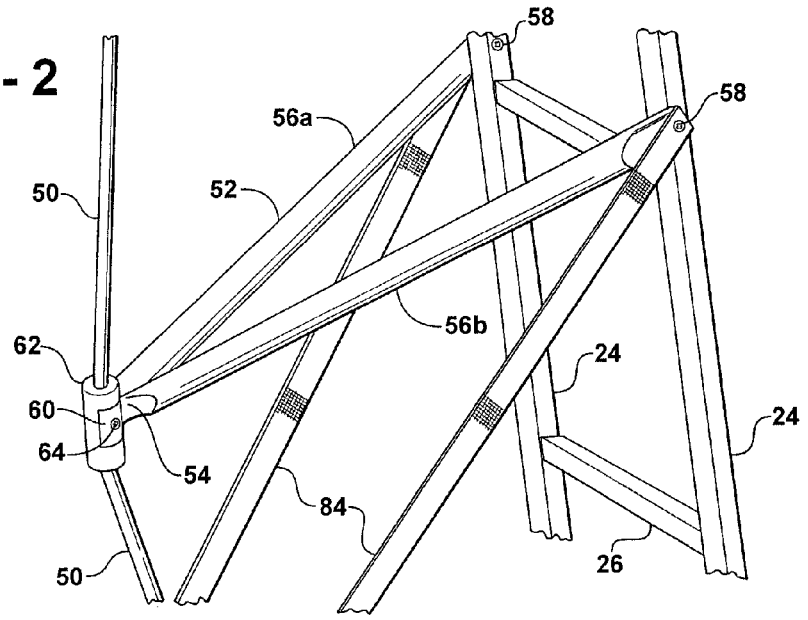
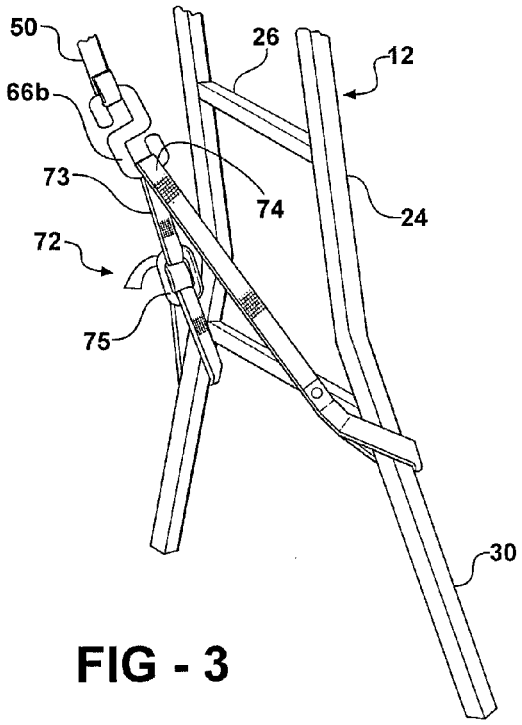
FIG - 3
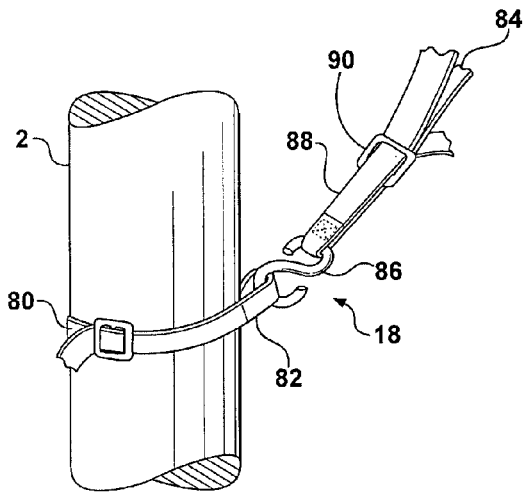
FIG - 4

CABLE-BRACED LADDER TREE STAND

CROSS-REFERENCE TO RELATED APPLICATIONS

This application claims the benefit of U.S. Provisional Application No. 60/872,105, filed on Dec. 1, 2006.

FIELD OF THE INVENTION

The invention relates to ladder supported tree stand for hunters, and more particularly, the invention relates to a ladder supported tree stand for hunters having a collapsible ladder tree stand and ladder combination wherein a platform is supported in part by a collapsible ladder that, in the erected position, is reinforced by a cable or wire.

BACKGROUND OF THE INVENTION

Hunters frequently employ elevated platforms, commonly referred to as tree stands, from which to observe and hunt wildlife. Generally, tree stands are fixed to the trunk of a tree at a desired distance above the ground. With most types of tree stands, ladders are commonly attached to the tree or to the stand itself to provide convenient access to the tree stand. Furthermore, it is well known to combine a ladder with the elevated platform so that the ladder not only permits access to the elevated platform, but also provides some or all of the support for the elevated platform when it is positioned for use. This type of tree stand is commonly referred to as a ladder tree stand.

Portable ladder tree stands are in wide use by hunters, photographers and wildlife observers. Exemplars of this type of tree stand are found in U.S. Pat. No. 5,279,390 to Phillips, issued on Jan. 18, 1994, as well as U.S. Pat. No. 6,053,278 to Myers, issued on Apr. 25, 2000. These types of stands often include both a seating platform as well as a foldable or sectional ladder.

Heretofore, a ladder tree stand comprising a seating platform assembly, a ladder assembly, and a truss assembly having a flexible cable and a brace that induces tension in the flexible cable to thereby brace there ladder assembly against deflection has not been known.

SUMMARY OF THE INVENTION

The present invention provides a ladder tree stand for supporting a hunter at an elevated position. The ladder tree stand includes a seating platform assembly, a ladder assembly, and a truss assembly. A strap assembly may also be provided.

The seating platform assembly has a standing platform, a seat suspended above the standing platform, and a claw for frictionally engaging the tree.

The ladder assembly has a plurality of interconnecting ladder segments, and each ladder segment has a plurality of rungs extending between a pair of opposed side rails. The ladder segments are connected end to end from a lower end of the ladder assembly to a upper end of the ladder assembly, and the upper end of the ladder assembly is supportingly connected to the seating platform assembly. Additionally, the ladder assembly may include a flared base at the lower end of the ladder assembly, and a flared upper portion at the upper end of the ladder assembly.

The truss assembly includes a flexible cable and a substantially rigid brace. The flexible cable has a first end and a second end. The first end of the flexible cable is connected to the ladder assembly near the upper end of the ladder assembly by a forked upper connector. The second end of the flexible cable is connected to the ladder assembly near the lower end of the ladder assembly by a forked lower connector. The brace has a first leg connected to a second leg at an apex. The first leg of the brace is pivotally connected to one of the opposed side rails of the ladder assembly, and the second leg of the brace is pivotally connected to the other of the opposed side rails of the ladder assembly. The brace engages the flexible cable adjacent to the apex of the brace to space an intermediate portion of the flexible cable from the ladder assembly for tensioning the flexible cable to thereby brace the ladder assembly against deflection. The forked upper connector and the forked lower connector may have adjustable lengths. Alternatively, the forked upper connector and the forked lower connector may be substantially rigid and pivotally connected to the ladder assembly. Also, the brace may be positioned near the longitudinal midpoint of the ladder assembly.

The strap assembly is connected to the ladder assembly for engaging the tree. The strap assembly includes a circumferential strap for encircling the tree, a strap loop connected to the circumferential strap, a Y-strap connected to the ladder assembly, and a hook connected to the Y-strap at a mid portion thereof. The hook is selectively engageable with the strap loop to secure the Y-strap with respect to the circumferential strap.

BRIEF DESCRIPTION OF THE DRAWINGS

The description herein makes reference to the accompanying drawings wherein like referenced numerals refer to like parts throughout several views and wherein:

FIG. 2 is a perspective view of the central brace and flexible cable of the cable-braced tree stand according to the present invention;

FIG. 3 is a perspective view of the lower connector of the cable-braced tree stand according to the present invention; and FIG. 4 is a perspective view of the strap assembly of the cable-braced tree stand according to the present invention.

DETAILED DESCRIPTION OF THE INVENTION

Figure 1:
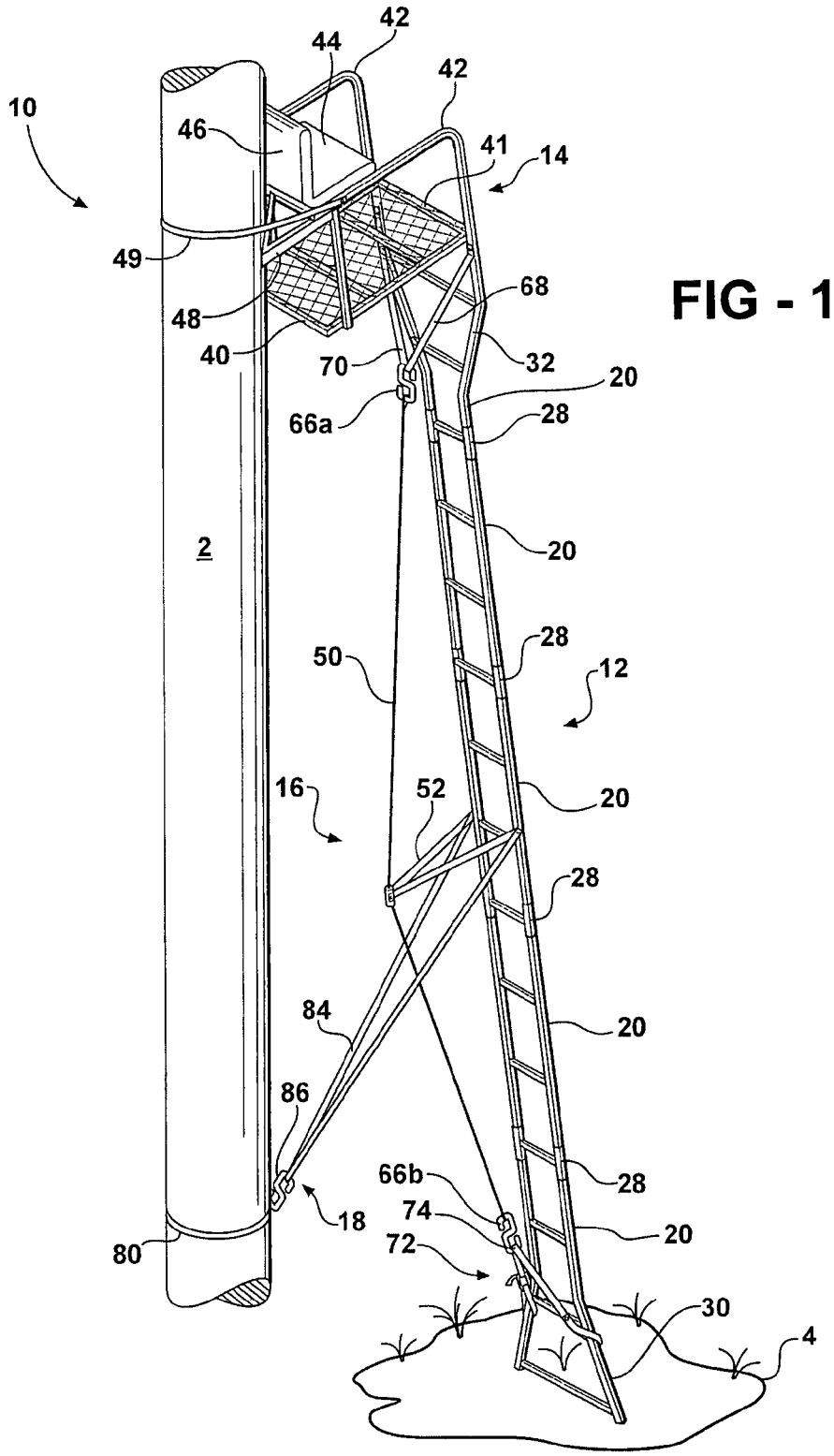
FIG. 1 is a perspective view showing a cable-braced tree stand according to the present invention, wherein the tree stand is assembled and positioned in relation to a tree

Referring to the drawings, the present invention will now be described in detail with reference to the disclosed embodiment.

FIG. 1 shows a tree stand 10 of the present invention. The tree stand 10 is designed to be positioned in engagement with a tree 2 or other vertical support along with a supporting surface, such as the ground 4. Stated most generally, the tree stand 10 includes a ladder assembly 12, a seating platform assembly 14, and a truss assembly 16 for bracing the ladder assembly 12 against deflection. The tree stand 10 may also include a strap assembly 18 that connects the ladder assembly 12 to the tree 2, thereby further securing the tree stand 10. While the tree stand 10 is particularly designed to support hunters or outdoorsmen in an elevated position, it will be appreciated that it may be utilized in any environment where a portable and secure elevated platform is desired.

So that the tree stand 10 may be easily transported, the ladder assembly 12 includes a plurality of ladder segments 20 that are connected end to end from a lower end of the ladder assembly 12, to a upper end of the ladder assembly 12. The ladder segments 20 are interconnected by a plurality of couplings 28. The couplings 28 may be of any variety of well-known mechanical devices including, but not limited to hinges or tube and socket type couplings. The use of couplings 28 permits the ladder segments 20 to be either folded or separated with respect to one another at the couplings 28 to allow the ladder assembly 12 to be collapsed to an overall length that may be conveniently stored and carried. As best seen in FIG. 2, each ladder segment 20 includes a pair of side rails 24 separated by and supporting a plurality of ladder rungs 26, which, when the ladder assembly 12 is assembled, serve as foot holds that the user may utilize to ascend and descend the ladder assembly 12.

With further reference to FIG. 1, it is seen that the ladder segments 20 of the ladder assembly 12 at the lower and upper ends thereof may constitute a flared base portion 30 and a flared upper portion 32, respectively. The flared base portion 30 provides additional stability to the tree stand 10 by providing a wider footprint for contact of the lower end of the ladder assembly 12 with the ground 4. The flared upper portion 32 of the ladder assembly 12 provides a wider attachment point for the seating platform assembly 14, to allow unimpeded movement of the user between the ladder assembly 12 and the seating platform assembly 14. When the plurality of ladder segments 20 are assembled together, the ladder assembly 12 provides sufficient overall length to permit the seating platform assembly 14 to be placed in a position substantially above the ground. When the plurality of ladder segments 20 are folded or disassembled in relation to one another, the ladder assembly 12 may be compactly stored or transported.

The upper end of the ladder assembly 12 is connected to the seating platform assembly 14. While the seating platform assembly 14 can be provided in various forms, the seating platform assembly 14 shown herein includes a seat frame 40, a pair of seat arms 42, a seat 44 and a seat back 46. The seat arms 42 are connected to the seat frame 40, and the seat 44 and the seat back 46 are supported by the seat arms. So that the user may assume a standing position while using the tree stand 10, the seating platform assembly 14 may include a standing platform 41, in the form of a substantially planar element connected to the seat frame 40, a plurality of tubular frame elements connected to the seat frame 40, or other structure adapted to allow a user to stand thereon.

To frictionally engage the seating platform assembly 14 with the tree 2, the seating platform assembly 14 includes a claw 48 that has a blade, a plurality of teeth, or another suitable structure adapted to frictionally engage the tree 2 when the tree stand 10 is assembled and erected. The claw 48 is positioned at the rear of the seating platform assembly 14, opposite the connection between the ladder assembly 12 and the seating platform assembly 14, and may be connected to the seat frame 40, the seat arms 42, or any other portion of the seating platform assembly 14. In order to maintain the claw 48 in engagement with the tree 2 when the tree stand 10 is in the erected position, a strap 49 is connected to the seating platform assembly 14. In particular, a first end of the strap 49 is connected to the seating platform 14 near the claw on one side of the seating platform assembly 14, the strap 49 extends around the tree 2, and a second end of the strap 49 is connected to the seating platform assembly 14 on the opposite side of the seating platform assembly 14.

In order to brace and stiffen the ladder assembly 12, the tree stand 10 includes the truss assembly 16. The truss assembly 16 includes a flexible cable 50 and a central brace 52. The flexible cable 50 has a first end that is connected to the ladder assembly 12 near the upper end of the ladder assembly 12, and a second end that is connected to the ladder assembly 12 near the lower end of the ladder assembly 12. The flexible cable 50 is adapted to serve as a tensile member, so that the flexible cable 50 may exert a tensile force on both the upper and lower ends of the ladder assembly 12. Accordingly, the flexible cable 50 may fabricated from any material suitable to develop a tensile force therein, including, but not limited to a steel cable, a rope, or a strap. The central brace 52 is connected to the ladder assembly 12, and serves as a compression member that spaces an intermediate portion of the flexible cable 50 from the ladder assembly 12 by engagement of the central brace 52 with the flexible cable 50 at an apex 54 of the central brace 52. When assembled, the central brace 52 of the truss assembly 16 is positioned substantially perpendicular to the side rails 24 of the associated ladder segment to which the central brace 52 is pivotally attached at the hinges 58. By rotating the central brace 52 into a position which is perpendicular to the side rails 24 of the ladder segment 20 to which the central brace is pivotally attached, tension is placed on cable 14 which serves to urge the ladder segments 20 together, while at the same time causing the assembled ladder element 14 to bow slightly outward away from the apex 54 of the central brace 52.

As best seen in FIG. 2, the central brace 52 is a substantially V-shaped member that includes a first leg **56*a* and a second leg 56*b* that meet at the apex 54 of the central brace 52. The first leg 56*a* and the second leg 56*b* are each connected to a respective side rail 24 of one of the ladder segments 20 of the ladder assembly 12. In order to allow the central brace 52 to be folded with respect to the ladder segment 20 to which it is connected for purposes of transportation and storage, the legs 56*a*, 56*b* of the central brace 52 may be pivotally connected to the side rails 24 of the ladder segment 20, for example, by a hinge 58 provided on each side rail 24 of the ladder segment 20. Furthermore, the central brace 52 is connected to the ladder assembly 12 intermediate the upper and lower ends thereof, and may be positioned at or near a longitudinal midpoint of the ladder assembly 12. In order to provide secure engagement between the central brace 52 and the flexible cable 50, appropriate connectors or complementary engagement surfaces may be provided on the central brace 52 and the flexible cable 50. By way of example, the central brace 52 may include a U-shaped flange 60 that located at the apex 54 of the central brace 52. The U-shaped flange 60 is sized to receive an engage and elongate tubular busing 62 that is disposed on the flexible cable 50. The tubular busing 62 is connected to the flexible cable 50 at a fixed position thereon. Optionally, fasteners 64 may be employed to secure the tubular bushing 62 to the U-shaped flange 60. For example, the fasteners 64 may be bolts or pins that extend through both the U-shaped flange 60 and the tubular bushing 62**.

While it is contemplated that the flexible cable 50 may be connected directly to the ladder assembly 12 using appropriate fasteners, an upper connector 68 and a lower connector 72 are provided to connect each end of the flexible cable 50 to both side rails 24 of the ladder assembly 12 to distribute the tension induced in the ladder assembly 12 by the flexible cable 50. Accordingly, the upper connector 68 and the lower connector 72 are both members that are connected to each side rail 24 of the ladder assembly 12 at a fixed point thereon and operative to transmit tension between the flexible cable 50 and the ladder assembly 12, thus providing a forked configuration for the upper and lower connectors 68, 72. Connection and disconnection of the flexible cable 50 and the upper and lower connectors 68, 72 is accommodated by a first hook **66*a* located on the upper end of the flexible cable 50 for engagement with the upper connector 68 at a midpoint 70 of the upper connector 68 and a second hook 66*b* located on the lower end of the flexible cable 50 for engagement with the lower connector 72 at a midpoint 74 of the lower connector 72. While various structures may be employed as the upper and lower connectors 68, 74, it is specifically contemplated that the upper and lower connectors 68, 74 may be webbed straps 73 that are tied to each side rail 24 of the ladder assembly 12 at the intersection of the side rails 24 with a rung 26, as shown in FIG. 3, wherein the lower connector 72 is shown as representative of both the upper and lower connectors 68, 72. Furthermore, the webbed straps 73 may be provided with buckles 75 or other means for tensioning and adjusting the upper and lower connectors 68, 72. Alternatively, the upper and lower connectors 68, 72 may be rigid braces that are pivotally connected to the ladder assembly 12, similar in construction to the central brace 52**.

In order to secure the ladder assembly 14 to the tree 2, the strap assembly 18 extends from an intermediate point along the ladder assembly 14 to the tree 2. As shown in FIG. 4, the strap assembly 18 includes a circumferential strap 80 that is adapted to be secured around the tree 2. A strap loop 82 is connected to and extends outward from the circumferential strap 80. The strap loop 82 serves as a connection point to which various types of connectors may be selectively connected and disconnected with respect to the tree 2. A Y-strap 84 is connected to the ladder assembly 12 and to the circumferential strap 80. In particular, the Y-strap 84 is connected to both side rails 24 of one of the ladder segments 20, and may be connected to the ladder assembly 12 by the hinges 58 that also connect the central brace 52 to the ladder assembly 12. A hook 86 is connected to a mid-portion 88 of the Y-strap 84, and the hook 86 engages the strap loop 82 to connect the Y-Strap 84 to the circumferential strap 80. Furthermore, a buckle 90 may be provided on the Y-strap 84 in order to tighten the strap assembly 18. By positioning the circumferential strap 80 at a position which is vertically closer to the ground 4 than the hinges 58 of central brace 52, the entire tree stand assembly 10 may be pulled both toward the tree 2 and downward toward the ground 4 through engagement of the Y-strap 84 with the circumferential strap 80. However, it should be recognized that although the strap assembly 18 is described herein as including the circumferential strap 80, the strap loop 82, the Y-strap 84, and associated elements, it should be understood that the strap assembly 18 is not limited to these structures, but rather, may comprise any structure operative to pull the mid-potion of the ladder assembly 14 downward and toward the tree 2.

In use, the tree stand 10 is erected by first assembling the ladder assembly 12 and the seating platform assembly 14 on the ground. The truss assembly 16 is then engaged by pivoting the central brace 52 into position to tension the flexible cable 50, and by adjusting the upper and lower connectors 68, 72 as necessary to vary the tension in the flexible cable 50. Once the ladder assembly 12, the seating platform assembly 14, and the truss assembly 16 are assembled, those portions of the tree stand 10 are positioned with respect to the tree. Finally, the strap assembly 18 is engaged by placing the circumferential strap 80 around the tree 2 and connecting the Y-strap 84 to the circumferential strap 80 using the hook 86 and the strap loop 82. The Y-strap 84 is then tightened as necessary to secure the ladder assembly 12 with respect to the tree 2. Disassembly of the tree stand 10 is the inverse procedure of the above-recited erection and installation. In other words, the hook 86 is removed from the strap loop 82. The tree stand 10 is then lowered to the ground 4, where disassembly commences. The central brace 52 is rotated so that it is substantially parallel to the side rails 24 of the ladder assembly 12, thereby relieving substantial tension from the flexible cable 50. This permits the ladder segments 20 to be separated from one another or folded, allowing the ladder assembly 12 to be collapsed into a portable configuration. Furthermore, the seat assembly 16 is also provided with couplings and/or hinges to allow the seat frame 40, the seat arms 42, the seat 44 and the seat back 46 to be folded and collapsed into a flattened package, thus allowing the tree stand 10 to be readily transportable to and from the desired site.

While the invention has been described in connection with what is presently considered to be the most practical and preferred embodiment, it is to be understood that the invention is not to be limited to the disclosed embodiments, but to the contrary, it is intended to cover various modifications or equivalent arrangements included within the spirit and scope of the appended claims. The scope is to be accorded the broadest interpretation so as to encompass all such modifications and equivalent structures as is permitted under the law.

I claim:

1. A ladder tree stand for supporting a hunter at an elevated position above ground, comprising:

a seating platform assembly adapted for frictional engagement with a tree;

a ladder assembly having a plurality of interconnecting ladder segments, each ladder segment having at least one rung extending between a pair of opposed side rails, said ladder segments connected end to end from a lower end of said ladder assembly to an upper end of said ladder assembly;

a truss assembly including a flexible cable and a brace, said flexible cable having a first end connected to said ladder assembly near said upper end of said ladder assembly and a second end connected to said ladder assembly near said lower end of said ladder assembly, and said brace connected to said ladder assembly and in engagement with said flexible cable to space an intermediate portion of said flexible cable from said ladder assembly for tensioning said flexible cable urging said ladder assembly to bow outward away from said flexible cable to brace said ladder assembly against deflection; and a strap assembly connected to a middle portion of said ladder assembly for engaging the tree, the strap assembly urging said ladder assembly to bow inward toward the tree and downward toward the ground to counteract the bowing urged by the flexible cable, wherein the brace of said truss assembly and said strap assembly are connected to said ladder assembly at the same location.

2. The ladder tree stand stated in claim 1, further comprising:

a forked upper connector for connecting said first end of said flexible cable to said upper end of said ladder assembly; and a forked lower connector for connecting said second end of said flexible cable to said lower end of said ladder assembly.

3. The ladder tree stand stated in claim 2, wherein said upper connector and said lower connector have adjustable lengths.

4. The ladder tree stand stated in claim 2, wherein said upper connector and said lower connector are substantially rigid and pivotally connected to said ladder assembly.

5. The ladder tree stand stated in claim 1, wherein said brace is substantially rigid and pivotally connected to said ladder assembly.

6. The ladder tree stand stated in claim 1, wherein said brace includes a first leg connected to a second leg at an apex, said first leg of said brace and said second leg of said brace pivotally connected to said ladder assembly, and said brace engages said flexible cable adjacent to said apex of said brace.

7. The ladder tree stand stated in claim 1, wherein said brace is positioned near the longitudinal midpoint of said ladder assembly.

8. The ladder tree stand stated in claim 1, wherein said ladder assembly includes a flared base at said lower end of said ladder assembly.

9. The ladder tree stand stated in claim 1, wherein said ladder assembly includes a flared upper portion at said upper end of said ladder assembly.

10. The ladder tree stand stated in claim 1, wherein said seating platform assembly includes a claw for frictionally engaging the tree.

11. The ladder tree stand stated in claim 1, wherein said seating platform assembly includes a standing platform and a seat suspended above said standing platform.

12. The ladder tree stand stated in claim 1, wherein said strap assembly includes a circumferential strap for encircling the tree, a strap loop connected to said circumferential strap, a Y-strap connected to said ladder assembly, and a hook connected to said Y-strap at a mid portion thereof, wherein said hook is selectively engageable with said strap loop to secure said Y-strap with respect to said circumferential strap.

13. The ladder tree stand as set forth in claim 1 wherein the strap assembly is selectively adjustable for counteracting the bowing of the ladder assembly urged by said flexible cable.

14. The ladder tree stand as set forth in claim 13 wherein the strap assembly comprises a selectively releasable fastening member to fix the strap assembly at a selected adjustment.

15. The ladder tree stand as set forth in claim 14 wherein the fastening member comprises a buckle.

* * * * *